United States Patent [19]

Sawada et al.

[11] Patent Number: 4,643,964

[45] Date of Patent: Feb. 17, 1987

[54] HEAT-DEVELOPABLE LIGHT-SENSITIVE MATERIAL WITH ELECTRICALLY CONDUCTIVE LAYER

[75] Inventors: Satoru Sawada; Hideki Naito; Hiroshi Kitaguchi, all of Kanagawa, Japan

[73] Assignee: Fuji Photo Film Co., Ltd., Kanagawa, Japan

[21] Appl. No.: 757,556

[22] Filed: Jul. 22, 1985

[30] Foreign Application Priority Data

Jul. 20, 1984 [JP] Japan ..... 59-151815

[51] Int. Cl.[4] ..... G03C 1/76; G03C 1/49

[52] U.S. Cl. ..... 430/523; 430/203; 430/617; 430/619; 219/216

[58] Field of Search ..... 430/523, 510, 617, 619, 430/203; 219/216

[56] References Cited

U.S. PATENT DOCUMENTS 3,748,137 7/1973 Worth et al. ..... 430/63
4,409,316 10/1983 Zeller-Pendrey et al. ..... 430/617
4,500,626 2/1985 Naito et al. ..... 430/619

*Primary Examiner*—Richard L. Schilling
*Attorney, Agent, or Firm*—Sughrue, Mion, Zinn, Macpeak, and Seas

[57] ABSTRACT

A heat-developable light-sensitive material is described, comprising a support having thereon a heat-developable silver halide emulsion layer capable of being developed by heating and further comprising said same support or the other support having thereon an electrically conductive layer, wherein the electrically conductive layer comprises at least (1) a compound imparting electrical conductivity, (2) a compound having a melting point of 100° C. or more, and (3) a hydrophilic binder.

18 Claims, 3 Drawing Figures

HEAT-DEVELOPABLE LIGHT-SENSITIVE MATERIAL WITH ELECTRICALLY CONDUCTIVE LAYER

FIELD OF THE INVENTION

The present invention relates to a heat-developable light-sensitive material. More particularly, it is concerned with a heat-developable silver halide light-sensitive material with electrically conductive layer which can produce good images as a result of heat development by heat generated when an electric current is charged to this electrically conductive layer.

BACKGROUND OF THE INVENTION

Heat-developable light-sensitive materials and processes for processing the same are described in, for example, *Shashin Kogaku no Kiso (Fundamentals of Photographic Engineering),* Corona Co., Ltd., Tokyo, pp. 553 to 555 (1979), *Eizo Joho (Image Information),* page 40, April (1978), *Nebletts Handbook of Photography and Reprography,* 7th Ed., Van Nostrand Reinhold Company, pp. 32–33, U.S. Pat. Nos. 3,152,904, 3,301,678, 3,392,020, 3,457,075, British Patents Nos. 1,131,108, 1,167,777, and *Research Disclosure,* June 1978, pp. 9–15 (RD-17029).

These heat-developable light-sensitive materials are heat-developed by techniques such as a method of contacting the light-sensitive material with a hot plate of great capacity, a method of directly heating the light-sensitive material by irradiating with a laser, infrared rays, supersonic waves, high frequency waves, or the like, and a method of passing the light-sensitive material through heated gas. These conventional methods, however, have many disadvantages and are not sufficiently satisfactory for practical use. For example, the method utilizing a hot plate has disadvantages in that much time is taken in order to give uniform temperature to the hot plate and, therefore, the amount of electricity consumed is large and, further, if the light-sensitive material is not brought into close contact with the hot plate, uniform conduction of heat to the light-sensitive material is difficult. The method utilizing radiation such as from a laser has a disadvantage in that a compact system is difficult to design because the apparatus is inevitably increased in size as a result of the use of the radiation. A major disadvantage of the method utilizing gas is that much time is taken for the processing because the heat capacity of gas is small.

In order to overcome the above problems, several methods have been proposed. One of the methods is to use a heat generating electrically conductive layer in combination with a heat-developable light-sensitive layer. This method is described in, for example, U.S. patent application Ser. No. 206,368 now abandoned and Japanese Patent Application (OPI) No. 66442/73 (the term "OPI" as used herein refers to a "published unexamined Japanese patent application"). In accordance with this method, however, it is generally difficult to obtain sharp images in short periods of time although a compact system can be realized. In conventionally used electrically heat generating layers (i.e., layers generating heat by charging thereto with electric current) of cellulose based polymers, for example, the electric resistance does not greatly change with temperature and, therefore, the layers are easily overheated when a constant voltage is applied thereto. For this reason, the conventional electrically heat generating layers cannot be heated to a given temperature rapidly and in a stabilized manner. In order to avoid this overheating, it is necessary to employ a heating system having a control function to detect the actual temperature of the layer and to change the voltage according to the difference between the established temperature and the actual temperature. The conventional electrically heat generating layers have additional disadvantages. One of the disadvantages in respect of performance is that an unevenness (i.e., ununiformity) in the electric resistance over the light-sensitive material produces an unevenness in the heating temperature. This will lead to uneven development of the light-sensitive material. Another disadvantage is that explosionproof coating equipment is needed because binder polymers soluble only in organic solvents are used; that is, the conventional electrically heat generating layers are unsatisfactory from the viewpoints of safety and workability and also from an economical standpoint. Further disadvantage is that the light-sensitive material having such an electrically heat generating layer is not well balanced in curling because the light-sensitive material usually comprises a support, a light-sensitive layer containing gelatin as a binder provided on one side of the support and an electrically conductive layer made mainly of an organic solvent-soluble binder provided on the other side of the support; that is, the two layers provided on both sides of the support are made of different polymers.

As another method to overcome the above described problems, various positive types of electrically conductive layers (i.e., electrically conductive layers increasing their electric resistance as the temperature is increased) have been developed as plate shaped heaters (see, for example, Japanese Patent Application (OPI) Nos. 82734/74, 82735/74, 13991/76, 39742/76, 39743/76 and 87694/77). Since, however, these plate shaped heaters are intended to be used repeatedly, the unevenness in the heating temperature is accounted of little unless water-insoluble binders such as binders less influenced by the circumstances and binders dissolved in organic solvents or latexes are used. Thus, this technology cannot be applied to heat-developable light-sensitive materials as it is.

In order to overcome the above described problems, a light-sensitive material suitable for heat development by passing electric current has already been proposed by the present inventors (see Japanese Patent Application No. 229377/83). In this light-sensitive material, however, it has been desired to further improve the electrically conductive layer.

SUMMARY OF THE INVENTION

One object of the present invention is to provide a heat-developable light-sensitive material which can be easily and uniformly heated to an established temperature in a short period of time without causing overheating for the purpose of development.

Another object of the present invention is to provide a heat-developable light-sensitive material which is good in the curl balance and is easy to handle.

Further object of the present invention is to provide an electrically conductive layer which when provided on a light-sensitive material, makes it suitable for heat development by passing electric current therethrough.

Still another object of the present invention is to provide an electrically conductive layer which is excellent in safety and workability during the production thereof.

A still further object of the present invention is to provide an image forming method whereby a heat-developable light-sensitive material can be uniformly heat developed by passing electric current therethrough, thereby producing a color image which is sharp and of high maximum density, and the white ground at nonimage areas is beautiful.

It has been found that the above objects can be attained by providing an electrically conductive layer which is prepared using at least (1) a compound imparting electrical conductivity, (2) a compound having a melting point of 100° C. or more, and (3) a hydrophilic binder.

Accordingly, the present invention relates to a heat-developable light-sensitive material comprising a support having thereon a heat-developable silver halide emulsion layer capable of being developed by heating and further comprising said same support or the other support having thereon an electrically conductive layer, wherein the electrically conductive layer comprises at least (1) a compound imparting electrical conductivity, (2) a compound having a melting point of 100° C. or more, and (3) a hydrophilic binder.

DETAILED DESCRIPTION OF THE INVENTION

Figure 1:
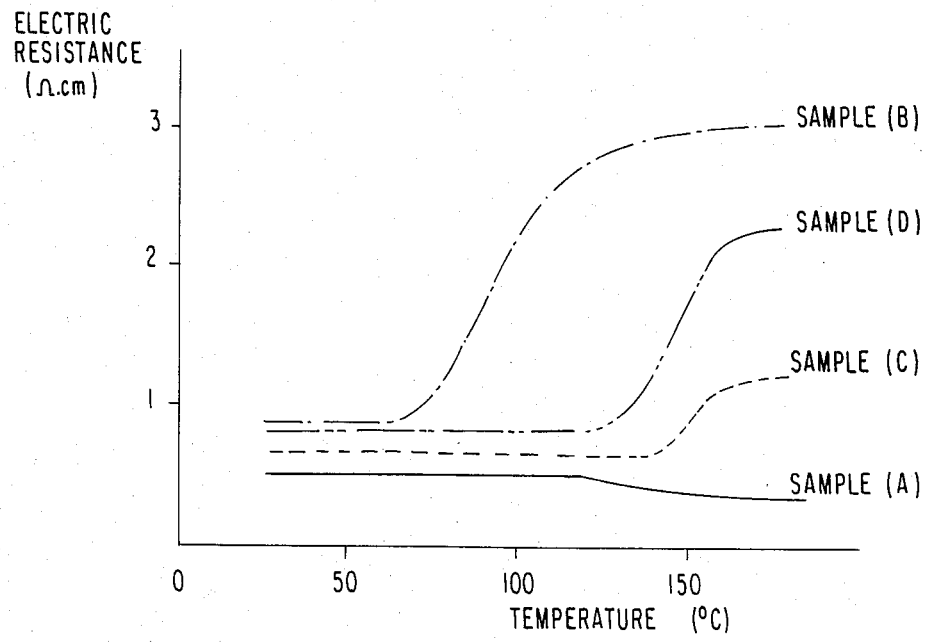
FIG. 1 is a graph showing changes in resistance with temperature of the light-sensitive materials produced in Example 1.

In a silver halide light-sensitive material which is heat-developed by application of electricity, at least one electrically conductive layer on a support generates heat when electric current is passed therethrough and at least one exposed light-sensitive layer is head-developed by the heat thus generated, thereby forming an image.

In the heat-developable light-sensitive material of the present invention, the heat generated in the electrically conductive layer also raises the temperature of the electrically conductive layer, thereby increasing its electric resistance. This produces advantages that the electric current passing through the electrically conductive layer can be automatically controlled even if the voltage applied is constant, the temperature of the light-sensitive material can be raised to a heat-developable level in a short period of time after application of electricity, and overheating can be prevented.

The electrically conductive layer of the heatdevelopable light-sensitive material of the present invention generates heat when electric current is charged on both sides of the electrically conductive layer. The initial volume resistance (i.e., initial resistibility) at room temperature of the electrically conductive layer is preferably from $10^{-4}$ to $10^{4}$ Ω cm and more preferably from $10^{-1}$ to $10^{1}$ Ω cm.

The electrically conductive layer may comprise various compositions. In a preferred embodiment, the electrically conductive layer comprises a binder and a finely divided electrical conductivity imparting compound dispersed therein. Further, as explained below, a compound having a melting point of 100° C. or more is required.

Typical examples of the electrical conductivity imparting compound are metals such as iron, copper, silver, nickel and platinum; alloys containing nickel and chromium as main components, such as nichrome and Kanthal alloy; noble metal alloys such as platinum/rhodium alloy; oxide semiconductors, such as silicon carbide, silicon molybdate, zirconia ($ZrO_2$), zinc oxide, titanium dioxide and thoria ($ThO_2$); graphite; and carbon black. Of these compounds, graphite and carbon black are preferably used because they are inexpensive.

An example of the carbon black is acetylene black which is known as electrically conductive carbon black. In the present invention, as well as the acetylene black, various types of carbon black can be used. These carbon blacks are described in J. B. Donnet & A. Voet, *Carbon Black,* Marcel Dekker Co. (1976), and are available from Columbian Carbon Company, Mitsubishi Kasei Kogyo Co., Ltd., and so on. The electrically conductive layer can also be prepared by coating a hydrophilic electrically conductive polymer alone as a binder. In this case, the electrical conductivity imparting compound also acts as a hydrophilic binder. Electrically conductive polymers which can be used are cationic polymer electrolytes such as polypiperidinium chloride and polyvinylbenzyltrimethylammonium chloride. These electrically conductive polymers may be used in combination with finely divided electrically conductivity imparting compound.

Binders for the electrical conductivity imparting compound which can be used in the present invention can be used alone or in combination with each other. Typical examples of the hydrophilic binder are transparent or translucent hydrophilic colloids, including natural substances such as proteins (e.g., gelatin or its derivatives), and polysaccharides (e.g., starch, gum arabic and cellulose derivatives), and synthetic polymers such as water-soluble polyvinyl compounds (e.g., polyvinyl pyrrolidone and acrylamide polymers). Of these binders, gelatin and polyvinyl alcohol are preferably used. Particularly preferred is gelatin.

The amounts of the electrical conductivity imparting compound and binder being compounded can be determined depending on the desired resistance value. In the present invention, as described above, the volume resistance (i.e., resistibility) is preferably from $10^{-4}$ to $10^{4}$ Ω cm and more preferably from $10^{-1}$ to $10^{1}$ Ω cm. For these resistance values, the amount of the necessary electrically conductive component added is from 10 to 90 wt %, preferably from 15 to 85 wt %, based on the total weight of the electrically conductive compound and binder. Especially good results can be obtained when as the electrically conductive compound, carbon black is used in an amount of from about 1 to 50 g/m$^2$, preferably from about 2 to 20 g/m$^2$. In this case, the carbon black content is from about 10 to 90 wt % and preferably from about 15 to 80 wt % based on the weight of binder.

In the electrically conductive layer of the present invention, the temperature at which its electric resistance begins to increase is 80° C. and preferably 100° C. It is preferred for the electrically conductive layer to have characteristics of the self resistance controlling type wherein the electric resistance at the developing temperature is from 1.5 to 10 times, preferably from 1.5 to 3 times, the initial electric resistance at room temperature. In order that a change in resistance with time of the electrically conductive layer and a variation pattern of the electric resistance can be easily designed, it is necessary to add a compound having a melting point of about 100° C. or more. In the present invention, the electrically conductive layer is part of the light-sensitive material and is not used repeatedly. Thus, those compounds that decompose at about 100° C. or more can be used as long as they permit attainment of the above object. Heat development is usually carried out at a temperature of 300° C. or less. Therefore, the above compound can be selected appropriately from compounds having a melting point or decomposition point of from about 100° to 300° C. Particularly preferred are compounds having a melting point of from 100° to 200° C.

Typical examples of compounds which have a melting point or decomposition point of about 100° C. or more and can be used for the above purpose are shown below along with their melting point.

Ethyleneurea (131° C.), propylurea (110° C.), phenylurea (147° C.), benzenesulfonamide (157° C.), p-chlorobenzenesulfonamide (146° C.), grape sugar (glucose) (146° C.), sugar (sucrose) (185° C.),

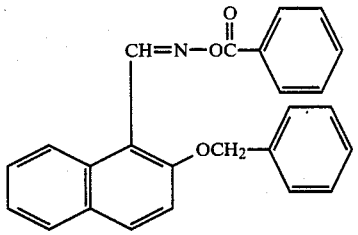

(131° C.),

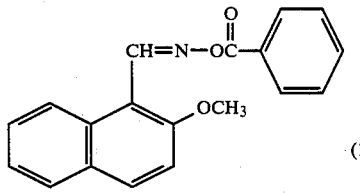

(127° C.),

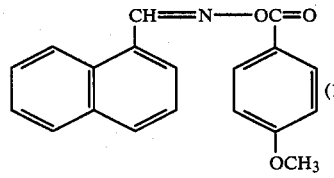

(152° C.).

Of these compounds, those compounds which are sparingly soluble in water are preferred from the viewpoint of, e.g., ease of controlling the grain size of the compound in the electrically conductive layer.

Other compounds having a melting point of 100° C. or more, which can be used in the present invention, can be easily found in R. C. Weast ed., *CRC Handbook of Chemistry and Physics,* 54th Ed., CRC Press Co., pp. C-75 to C-542 (1973), and *Catalog Handbook of Fine Chemicals,* Aldrich Co. (1984–1985). The examples are p-bromoacetanilide, 4,4'-bis(dimethylamino)benzophenone, 4-amino-2,6-dimethylpyrimidine, adipic acid, p-chlorophenoxyacetic acid, 1,4-diazabicyclo[2,2,2]octane, 2,4-dichlorophenoxyacetic acid, 1,3-dicyanobenzene, 5,5-dimethylhydantoin, dimethyl terephthalate, 1,3-diphenylguanidine, o-nitrobenzoic acid, 4-phenylphenol, α-tartaric acid, salicylamide and salicylic acid.

Those compounds remaining stable without undergoing decomposition or sublimation up to a temperature range 20° C. higher than the melting point are preferably used in the present invention. In an embodiment that the emulsion layer comes into contact with the electrically conductive layer when a fresh light-sensitive material is rolled, those compounds not exerting any photographic influences and also not exerting any adverse influences on the image formed are preferably used.

The amount of the compound added is from about 0.1 to 10 times, preferably from about 0.2 to 3 times, that of the binder.

The above described ingredients can be dispersed in the binder by known techniques.

The heat-developable light-sensitive material of the present invention can be produced in two embodiments. One embodiment is that the electrically conductive layer and light-sensitive layer may be provided on the same side of the support or on the opposite side relative to each other. In the other embodiment, the electrically conductive layer and light-sensitive layer may be provided on different supports, and then the resulting electrically conductive material and light-sensitive material are superposed on each other and combined together into one unit at an appropriate time. Either of the above embodiments can be employed as long as heat generated in the electrically conductive layer by passing electric current therethrough is conducted to the image forming layer including the exposed silver halide emulsion layer, thereby increasing the temperature of the image forming layer to a level necessary for development. In the case that the electrically conductive layer and light-sensitive layer are provided on different sides of the same support, the resulting light-sensitive material is well balanced in curling. In particular, it is preferred to use a water-soluble binder in the preparation of the electrically conductive layer because layers of nearly the same type are provided on both sides of the support.

In the present invention, various image forming substances can be used in various manners. Examples are couplers forming color images on coupling with the oxidized products of developing agents well known in the art and widely used in liquid development. Magenta couplers, for example, include a 5-pyrazolone coupler, a pyrazolobenzimidazole coupler, a cyanoacetylcumarone coupler, and a closed chain acylacetonitrile coupler. Yellow couplers include an acylacetamide coupler (e.g., benzoylacetanilides and pivaloylacetanilides). Cyan couplers include a naphthol coupler and a phenol coupler. Nondiffusing couplers having a hydrophobic group called a ballast group or polymerized couplers are desirable. These couplers may be 4-equivalent or 2-equivalent relative to silver ion. In addition, colored couplers having the effect of color correction, or couplers releasing a development inhibitor with the progress of development (so-called DIR couplers) can be used.

Dyes forming positive color images by the light-sensitive silver dye bleaching method can be used. Examples are dyes described in, for example, *Research Disclosure,* April, 1976, pp. 30–32 (RD-14433), *ibid.,* December, 1976, pp. 14–15 (RD-15227), and U.S. Pat. No. 4,235,957, and leuco dyes described in U.S. Pat. Nos. 3,985,565 and 4,022,617.

Dyes which a nitrogen containing heterocyclic group was introduced therein as described in *Research Disclosure,* May, 1978, pp. 54–58 (RD-16966) can also be used.

In addition, dye providing substances releasing a mobile dye by utilizing the coupling reaction with a reducing agent oxidized by the oxidation reduction reaction with silver halide or organosilver salt at high temperatures as described in European Patent Nos. 67,455, 79,056, and West German Patent No. 3,217,853, and dye providing substances releasing a mobile dye as a result of the oxidation reduction reaction with silver halide or organosilver salt at high temperatures as described in European Patent Nos. 66,282, 76,492, West German Patent No. 3,215,485, European Patent Nos. 119,470A2 and 120,306A2 can be used.

Dye providing substances which are useful in the present invention are represented by the following general formula (I):

$$D—Y \qquad (I)$$

wherein D represents a dye or its precursor portion, and Y represents a substrate functioning to change the diffusibility of the dye providing substance of the general formula (I) through the oxidation reduction reaction occurring during heat development.

"To change the diffusibility" means that (1) the compound of the general formula (I) which is originally nondiffusing is made diffusing or is allowed to release a diffusing dye, and (2) the compound of the general formula (I) which is originally diffusing is made nondiffusing. This is caused by either the oxidation or the reduction of Y depending on the properties of Y. Either route can be employed depending on the purpose.

Examples of compounds which the diffusibility is changed through the oxidation of Y are shown below.

So-called dye releasing redox substrates such as p-sulfonamidonaphthols (including p-sulfonamidophenols; typical examples are described in Japanese Patent Application (OPI) Nos. 33826/73, 50736/78 and European Patent No. 76,492), o-sulfonamidophenols (including o-sulfonamidonaphthols; typical examples are described in Japanese Patent Application (OPI) Nos. 113624/76, 12642/81, 16130/81, 16131/81, 4043/82, 650/82, U.S. Patent No. 4,053,312 and European Patent No. 76,492), hydroxysulfonamidoheterocyclic rings (typical examples are described in Japanese Patent Application (OPI) No. 104343/76 and European Patent No. 76,492), 3-sulfonamidoindoles (typical examples are described in Japanese Patent Application (OPI) Nos. 104343/76, 46730/78, 130122/79, 85055/82 and European Patent No. 76,492), and α-sulfonamidoketones (typical examples are described in Japanese Patent Application (OPI) Nos. 3819/78, 48534/79 and European Patent No. 76,492);

intramolecular assist type substrates of the type that release a dye by intramolecular nucleophilic attack after the oxidation of Y, as described in Japanese Patent Application (OPI) No. 20735/82 and Japanese Patent Application No. 177148/82;

substrates which release a dye by an intramolecular ring closing reaction under basic conditions but when Y is oxidized, substantially stop the dye release (typical examples are described in Japanese Patent Application (OPI) No. 63618/76);

substrates resulting from modification of the preceding substrates, which release a dye as a result of a ring rearrangement of the isooxazolone ring by a nucleophilic reagent (typical examples are described in Japanese Patent Application (OPI) Nos. 111628/74 and 4819/77); and substrates which release a dye portion through dissociation of an acidic proton under basic conditions but when Y is oxidized, substantially stop the release of the dye (typical examples are described in Japanese Patent Application (OPI) Nos. 69033/78 and 130927/79).

On the other hand, examples of compounds which the diffusibility is changed by the reduction of Y are nitro compounds described in Japanese Patent Application (OPI) No. 110827/78, and quinone compounds described in Japanese Patent Application (OPI) No. 110827/78, U.S. Pat. Nos. 4,356,249 and 4,358,525. These compounds are reduced by a reducing agent (called an "electron donor") remaining unconsumed after heat development, thereby producing a nucleophilic group, and release a dye by the intramolecular attack of the nucleophilic group. Quinone type substrates resulting from modification of the preceding compounds, which release a dye portion as a result of dissociation of an acidic proton of the reduction product, are also useful (typical examples are described in Japanese Patent Application (OPI) Nos. 130927/79 and 164342/81).

When the above substrates changing their diffusibility through the reduction are used, it is essential to use suitable reducing agents (electron donors) that cause a reaction between the silver salt oxidizing agent and the dye providing substance. Typical examples of such compounds are described in the above references. Substrates in which there is present an electron donor in the substrate Y are also useful.

As other dye providing compounds, compounds which undergo an oxidation reduction reaction with silver halide or organic silver salt at high temperatures and, as a result, change their mobility of compounds having a dye portion can be used. Details are described in Japanese Patent Application No. 39400/83.

Compounds releasing a mobile dye on reacting with silver ions in the light-sensitive material are described in Japanese Patent Application No. 55692/83.

Many of the above compounds produce an imagewise distribution of mobile dye in the light-sensitive material as a result of heat development. A method of visualizing the dye image by transferring to a dye fixing material (so-called heat diffusion transfer) is described in the above referenced patents and Japanese Patent Application Nos. 42092/83 and 55172/83.

Preferred among the compounds represented by the general formula (I) are compounds represented by the general formula (II) shown below as described in European Patent No. 76,492.

$$R—SO_2—D \qquad (II)$$

wherein R is a reducing substrate which cleaves in agreement with or in reverse agreement with a latent image formed in a light-sensitive silver halide, thereby releasing a dye and further which has a property of producing a difference in mobility between the dye released and the dye providing substance, and D is an image forming dye or its precursor portion which when released, becomes mobile; D can include a bonding group connecting the dye portion and the $SO_2$ group.

The oxidation reduction potential of the reducing substrate (R) of the dye providing substance $R—SO_2—D$ indicated against a saturated calomel electrode by the polarograph half-wave potential measurement using acetonitrile as a solvent and sodium perchlorate as a supporting electrolyte is preferably 1.2 v or less.

The general formula and typical examples of the reducing substrate represented by R are described in the above European Patent No. 76,492, pp. 7–24.

The dye portion represented by D is derived from an azo dye, an azomethine dye, an anthraquinone dye, a naphthoquinone dye, a styryl dye, a nitro dye, a quinoline dye, a carbonyl dye and a phthalocyanine dye, for example. This dye portion may be used in a temporary blue shifted form which is capable of regenerating during the development processing. The general formula and typical examples of the dye portion are described in European Patent No. 76,492, pp. 24–42.

The dye providing substance used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propiorate, secondary butyl alcohol, methyl isobutyl ketone $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

The silver halide used in the present invention includes silver chloride, silver chlorobromide, silver chloroiodide, silver bromide, silver iodobromide, silver chloroiodobromide and silver iodide, etc.

The process for preparing these silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 $\mu$m to 10 $\mu$m and more preferably from 0.001 $\mu$m to 5 $\mu$m.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

The silver halide used in the present invention can be spectrally sensitized with methine dyes or other dyes.

In the particularly preferred embodiment of the present invention, an organic silver salt oxidizing agent is used together. The organic silver salt oxidizing agent is a silver salt which forms a silver image by reacting with the image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessary to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458and Japanese Patent Application (OPI) Nos. 13224/74 and 17216/75.

A suitable coating amount of the light-sensitive silver halide and the organic silver salt oxidizing agent employed in the present invention is in a total of from 50 mg/m$^2$ to 10 g/m$^2$ calculated as an amount of silver.

In the present invention, if necessary, a reducing substances may be used. The reducing substances include reducing agents and aforementioned dye providing substances.

Examples of useful reducing agents include the compounds specifically described in U.S. Pat. No. 4,500,626.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, various kinds of dye releasing activators can be used. The dye releasing activator means a substance which accelerates the oxidation reduction reaction between the light-sensitive silver halide and/or the organic silver salt oxidizing agent and dye providing substance, or accelerates release of a dye by means of its nucleophilic action to the oxidized dye providing substance in the dye releasing reaction subsequently occurred, and a base and a base precursor can also be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. The base precursor is a substance which releases a basic component by heating. Examples of typical base precursors are described in British Patent No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of coated dry layer of the light-sensitive material. A range of 0.01% by weight to 40% by weight is more preferred.

It is advantageous to use a compound represented by the general formula described below in the heat-developable color photographic material in order to accelerate development and accelerate release of a dye.

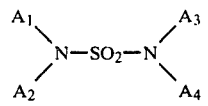

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ and/or $A_3$ and $A_4$ may combine with each other to form a ring.

The above described compound can be used in an amount of broad range. A useful range is up to 20% by weight based on the amount of coated dry layer of the light-sensitive material. A range of 0.1% by weight to 15% by weight is more preferred.

It is also advantageous to use a water releasing compound in the present invention in order to accelerate the dye releasing reaction.

The expression "water releasing compound" refers to a compound which releases water by decomposition during heat development. These compounds are particularly known in the field of printing of fabrics, and $NH_4Fe(SO_4)_2 \cdot 12H_2O$, etc., as described in Japanese Patent Application (OPI) No. 88386/75 are useful.

The binder which can be used in the light-sensitive material of the present invention can be employed individually or in a combination thereof A hydrophilic binder can be used as the binder according to the present invention. The typical hydrophilic binder is a transparent or translucent hydrophilic colloid, examples of which include a natural substance, for example, protein such as gelatin, a gelatin derivative, etc., a polysaccharide such as starch, gum arabic, a cellulose derivative, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acid salts (mucochloric acid salt, mucophenoxychloric acid salt, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layer thereto.

Examples of the hydrophilic thermal solvents include ureas, pyridines, amides, sulfonamides, imides, alcohols, oximes and other heterocyclic compounds.

Various means of exposure can be used in the present invention. Latent images are obtained by imagewise exposure to radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The heat-developable light-sensitive material of the present invention has various advantages. Some of the major advantages of the present invention are shown below.

(1) Since a hydrophilic binder is used as a binder for the electrically conductive layer, workability and safety during the coating process are good.

(2) When the light-sensitive emulsion layer is provided on one side of the support and the electrically conductive layer on the other side, the resulting light-sensitive material is excellent in the curl balance (3) The electrically conductive layer of the heat-developable light-sensitive material of the present invention is much superior in electric self resistance controlling property to the conventional layers. Thus, the light-sensitive material can be raised in temperature to a developing temperature without causing overheating by passing electric current only for a short period of time.

(4) Unevenness in the heating temperature can be reduced and uniform development can be accomplished. Thus, a beautiful image can be produced.

The present invention is described in greater detail with reference to the following examples, although it is not intended to be limited thereto.

EXAMPLE 1

Powdered carbon black (grain diameter: 50 μm) was dispersed in water with sodium naphthalenesulfonate (trade name: Demol N; produced by Kao Atlas Co., Ltd.) as a dispersing agent. The carbon black and sodium naphthalenesulfonate contents were 35 wt % and 2 wt %, based on the solution, respectively.

| | | |
|---|---|---|
| (1) | Carbon black dispersion as prepared above | 50 g |
| (2) | 5 vol % aqueous solution of a compound having the following formula: 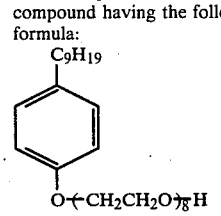 | 20 ml |
| (3) | Water | 20 ml |
| (4) | 10 wt % aqueous solution of gelatin | 100 g |

The above ingredients were mixed and dissolved by heating, and coated on a polyethylene terephthalate film in a wet thickness of 100 μm. The material thus prepared is referred to as Sample A.

A material (Sample B) was prepared in the same manner as in the preparation of Sample A except that a methanol solution of propylurea was further added in an amount (as solids) of 30 g. A material (Sample C) was prepared in the same manner as in the preparation of Sample A except that a methanol solution of phenylurea was further added in an amount (as solids) of 30 g. A material (Sample D) was prepared in the same manner as in the preparation of Sample A except that a compound having the following formula:

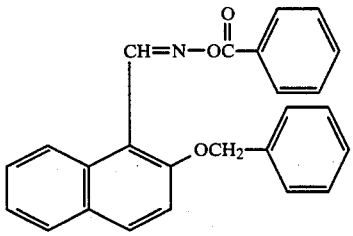

was further added in an amount of 30 g as a solid dispersion.

Figure 2:
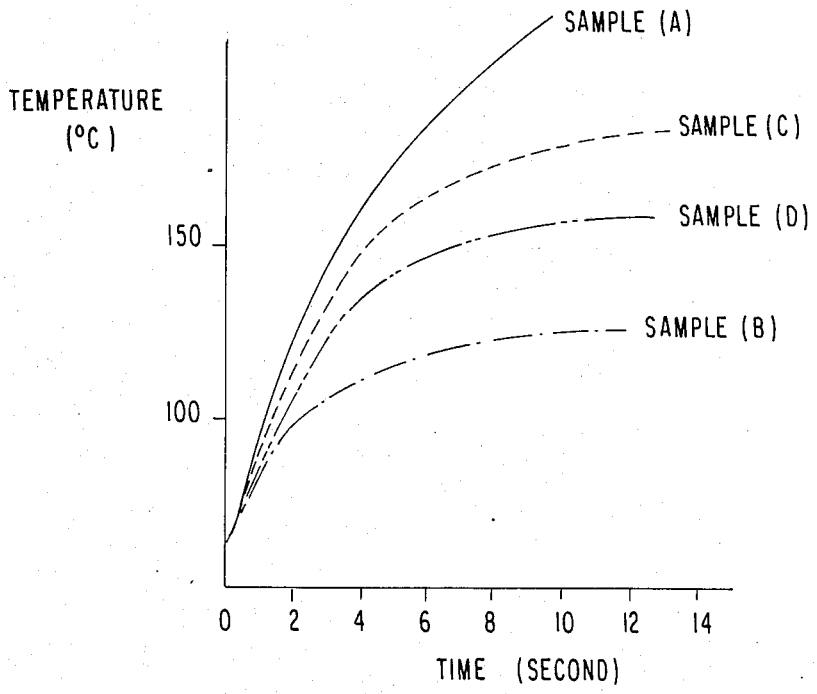
FIG. 2 is a graph obtained by plotting an increase in temperature of the light-sensitive materials produced in Example 1 when a voltage of 200 v is applied, against time.

The materials (Samples A to D) were measured for electric resistance at each temperature, and the results are shown in FIG. 1 and Table 1. Electrodes were attached to both ends of each material (sample), and the material was measured for an increase in temperature when a voltage of 200 v was applied. The results are shown in FIG. 2.

TABLE 1

| Sample No. | Additive (m.p.) | Ratio of Electric Resistance (170° C./25° C.) |
|---|---|---|
| A (Comparative Sample) | — | 0.7 |
| B (Sample of the Invention) | Propylurea (110° C.) | 3.6 |
| C (Sample of the Invention) | Phenylurea (147° C.) | 1.8 |
| D (Sample of the Invention) | Compound (I) (131° C.) | 2.9 |

Note:

Compound (I):

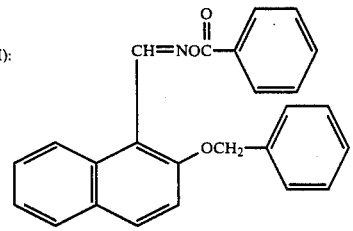

Ratio of Electric Resistance (170° C./25° C.): Ratio of an electric resistance at 170° C. to an eJectric resistance at 25° C.

It can be seen from the results of Table 1 that the electrically conductive layer of the present invention has the so-called positive type characteristics that the electric resistance increases when a specific temperature is reached. That is, the results demonstrate that even when a constant voltage is applied continuously, any increase in temperature is stopped and overheating can be automatically prevented.

EXAMPLE 2

Materials (Samples E to G) were prepared in the same manner as in the preparation of Sample D except that the amount of Compound (I) added was changed to 2 g, 20 g and 50 g, respectively.

Figure 3:
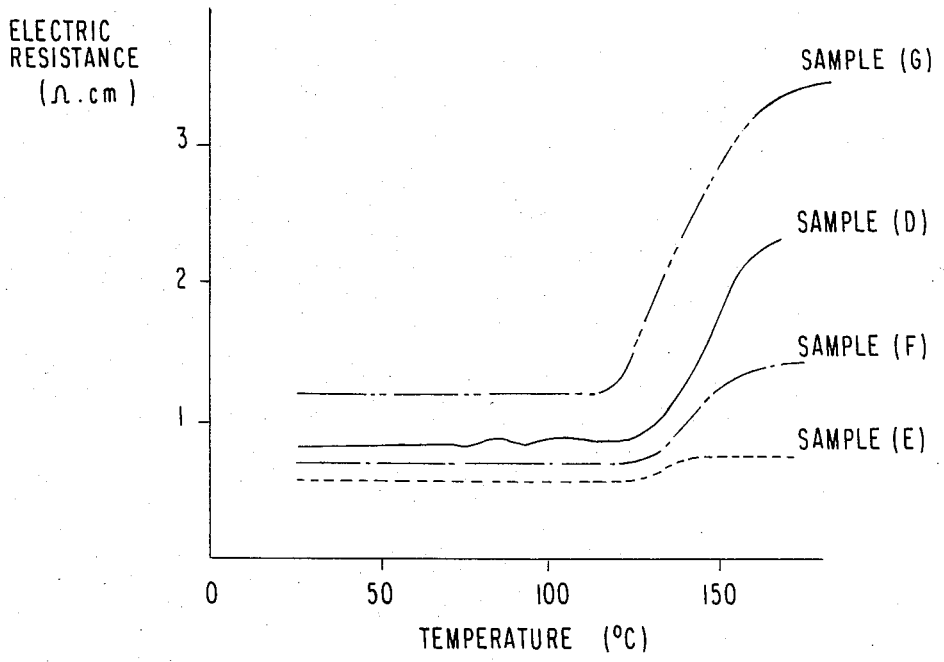
FIG. 3 is a graph showing the resistance-temperature characteristics of the light-sensitive materials produced in Example 2.

These materials (Samples E to G) were measured for resistance-temperature characteristics, and the results are shown in FIG. 3.

EXAMPLE 3

The following light-sensitive layer was provided on the opposite side of the material of Example 1 relative to the electrically conductive layer.

Preparation of Light-Sensitive Silver Halide Emulsion

A mixture of 40 g of gelatin and 26 g of potassium bromide (KBr) was dissolved in 3,000 ml of water, and the resulting solution was stirred while maintaining the temperature at 50° C.

A solution of 34 g of silver nitrate dissolved in 200 ml of water was added to the above solution over 10 minutes, and the silver iodobromide emulsion thus formed was precipitated to remove excess salts. Then the silver iodobromide emulsion was adjusted to pH 6.0. The yield was 400 g.

Preparation of Silver Benzotriazole Emulsion

A mixture of 28 g of gelatin and 13.2 g of benzotriazole was dissolved in 3,000 ml of water, and the resulting solution was stirred while maintaining the temperature at 40° C.

A solution of 17 g of silver nitrate dissolved in 100 ml of water was added to the above solution over 2 minutes. The silver benzotriazole emulsion thus formed was precipitated to remove excess salts. Then the silver benzotriazole emulsion was adjusted to pH 6.3. The yield was 400 g.

5 g of a dye providing substance (A) was added to a mixture of 10 g of tricresyl phosphate and 30 ml of ethyl acetate, and dissolved therein by heating at about 60° C. To the solution thus formed were added 100 g of a 10 wt % solution of gelatin and 10 ml of a 5 wt % aqueous solution of sodium p-alkylbenzenesulfonate (alkyl group: $C_{12}$–$C_{13}$), and they were then stirred and dispersed for 10 minutes at 10,000 rpm by the use of a homogenizer. The dispersion thus prepared is called a "dye providing substance dispersion".

Chemical Formula of Dye Providing Substance (A)

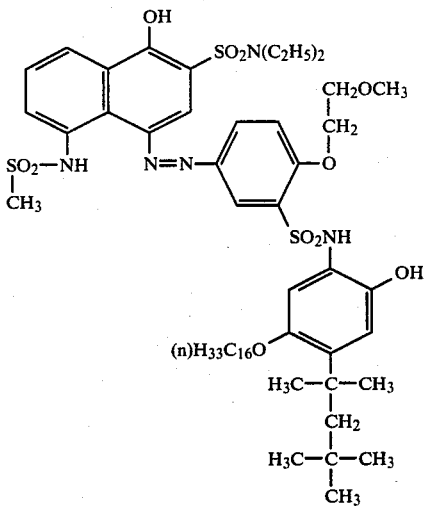

Preparation of Light-Sensitive Material

A light-sensitive layer was provided on the back of the support of Sample D prepared in Example 1 by the following procedure. This material is referred to as Light-Sensitive Material (I).

| | | |
|---|---|---|
| (a) | Silver iodobromide emulsion | 20 g |
| (b) | Silver benzotriazole emulsion | 10 g |
| (c) | Water | 3.5 ml |
| (d) | Dispersion of Dye providing Substance (A) | 33 g |
| (e) | 5 vol % aqueous solution of a compound having the following formula: 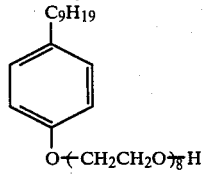 | 5 ml |
| (f) | 10 wt % ethanol solution of guanidinetrichloroacetic acid | 12.5 ml |
| (g) | 10 wt % aqueous solution of dimethylsulfamide | 4 ml |

The above ingredients were mixed, coated on a polyethylene terephthalate film in a wet thickness of 30 μm, and then dried. On the coating thus formed was further coated as a protective layer the following composition.

| | | |
|---|---|---|
| (a') | 10 wt % aqueous solution of gelatin | 35 g |
| (b') | 10 wt % ethanol solution of guanidinetrichloroacetic acid | 5 ml |
| (c') | 1 wt % aqueous solution of sodium 2-ethylhexylsuccinate sulfonate | 4 ml |
| (d') | Water | 56 ml |

The above ingredients were mixed, coated in a wet thickness of 25 μm, and then dried to prepare a light-sensitive material.

Preparation of Dye Fixing Material 10 g of a methyl acrylate/N,N,N-trimethyl-N-vinylbenzylammonium chloride (1/1) copolymer was dissolved in 200 ml of water and then uniformly mixed with 100 g of 10 wt % gelatin. The resulting mixture was uniformly coated in a wet thickness of 90 μm on a paper support laminated with polyethylene with titanium dioxide dispersed therein. The material thus prepared was dried and used as a dye fixing material with a mordant layer.

Light-Sensitive Material (I) was exposed imagewise with a tungsten lamp at 2,000 lux for 10 seconds. Then, a direct current was applied for 20 seconds at a voltage of 300 v by the use of a roller type electrode.

This light-sensitive material was exposed in the same manner as above and then heated for 30 seconds on a heat block maintained at 130° C.

The dye fixing material was soaked in water and, thereafter, the heated light-sensitive material was superposed on the dye fixing material in such a manner that the surface of coatings came into contact with each other. They were then heated for 6 seconds on a heat block maintained at 80° C. and the dye fixing material was separated from the light-sensitive material whereupon a negative magenta image was formed on the dye fixing material.

The negative image was measured for density to green light by the use of a Macbeth reflection densitometer (RD-519). For the material to which a voltage was applied, the maximum density was 2.21 and the minimum density was 0.14. On the other hand, for the material heated on the heat block, the maximum density was 2.15 and the minimum density was 0.14.

It can be seen from the above results that the light-sensitive material of the present invention can produce a sharp image of less unevenness even if an electric current is passed therethrough for a shorter period of time than that for which the light-sensitive material is heated on a heat block.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon a heat-developable silver halide emulsion layer capable of being developed by heating and further comprising said same support or another support having thereon an electrically conductive layer, wherein the electrically condutive layer comprises at least (1) a compound imparting electrical conductivity, (2) a meltable compound having a melting point of from about 100° C. to 300° C., and (3) a hydrophilic binder.

2. A heat-developable light-sensitive material as claimed in claim 1, wherein the initial volume resistance at room temperature of the electrically conductive layer is from $10^{-4}$ to $10^{4}$ Ω cm.

3. A heat-developable light-sensitive material as claimed in claim 1, wherein the compound imparting electrical conductivity in the electrically conductive layer is carbon black.

4. A heat-developable light-sensitive material as claimed in claim 1, wherein the compound imparting electrical conductivity and the hydrophilic binder in the electrically conductive layer is a hydrophilic electrically conductive polymer.

5. A heat-deveJopable light-sensitve material as claimed in claim 1, wherein the meltable compound having a melting point of about 100° C. to 300° C. remains stable without undergoing decomposition or sublimation up to a temperature range 20° C. higher than the melting point.

6. A heat-developable light-sensitive material as claimed in claim 5, wherein the meltable compound having a melting point of about 100° C. to 300° C. is sparingly soluble in water.

7. A heat-developable light-sensitive material as claimed in claim 1, wherein the (1) a compound imparting electrical conductivity, (2) a meltable compound having a melting point of about 100° C. to 300° C. and (3) a hydrophilic binder are all spearate constituents of the electrically conductive layer.

8. A heat-developable light-sensitive material as claimed in claim 7, wherein the (1) compound imparting electrical conductivity is from 10 to 90 wt % based on the total weight of the (1) compound imparting electrical conductivity and the (3) hydrophilic binder and wherein the amount of (2) the meltable compound having a melting point of about 100° C. to 300° C. is from 0.1 to 10 times that of the binder.

9. A heat-developable light-sensitive material as claimed in claim 7, wherein the (1) compound imparting electrical conductivity is from 15 to 85 wt % based on the total weight of the (1) compound imparting electrical conductivity and the (3) hydrophilic binder and wherein the amount of (2) the meltable compound having a melting point of about 100° C. to 300° C. is from 0.2 to 3 times that of the binder.

10. A heat-developable light-sensitive material as cliamed in claim 8, wherein (1) the compound imparting electrical conductivity is carbon black and the same is used in an amount of from 1 to about 50 g/m$^2$ and in an amount of from about 10 to 90 wt % based on the weight of the binder.

11. A heat-developable light-sensitive material as claimed in claim 9, wherein (1) the compound imparting electrical conductivity is carbon black and the same is used in an amount of from about 2 to about 20 g/m$^2$ and in an amount of from about 15 to 80 wt % based on the weight of the binder.

12. A heat-developable light-sensitive material as claimed in claim 1, wherein (2) the meltable compound having a melting point of about 100° C. to 300° C. also decomposes at about 100° C. or more.

13. A heat-developable light-sensitive material as claimed in claim 9, wherein (2) the meltable compound having a melting point of about 100° C. to 300° C. is selected from the group consisting of:

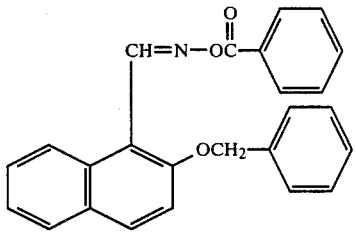

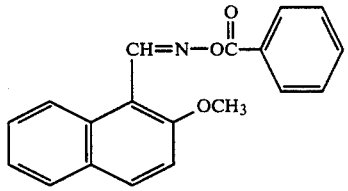

and

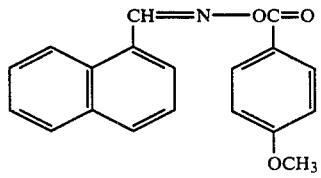

14. A heat-developable light-sensitive material as claimed in claim 9, wherein (2) the meltable compound having a melting point of about 100° C. to 300° C. is selected from the group consisting of p-bromoacetanilide, 4,4-bis(dimethylamino)benzophenone, 4-amino-2,6-dimenthylpyrimidine, adipic acid, p-chlorophenoxyacetic acid, 1,4-diazabicyclo[2,2,2]octane, 2,4-dichlorophenoxyacetic acid, 1,3-dicyanobenzene, 5,5-dimethylhydantoin, dimethyl terephthalate, 1,3-dipheynlguanidine, o-nitrobenzoic acid, 4-phenylphenol, α-tartaric acid, salicylamide and salicyclic acid.

15. A heat-developable light-sensitive material as claimed in claim 9, wherein the (2) meltable compound having a melting point of about 100° C. to 300° C. is propylurea.

16. A heat-developable light-sensitive material as claimed in claim 9, wherein the (2) meltable compound having a melting point of about 100° C. to 300° C. is phenylurea.

17. A heat-developable light-sensitive material as claimed in claim 9, wherein the (2) meltable compound having a melting point of about 100° C. to 300° C. is the compound:

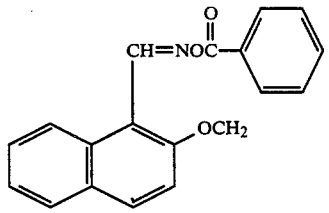

18. A heat-developable light-sensitive material as claimed in claim 1, wherein the meltable compound has a melting point of from 100° to 200° C.

* * * * *